United States Patent [19]

Oulsnam

[11] Patent Number: 4,498,817

[45] Date of Patent: Feb. 12, 1985

[54] ROOF BOLTS FOR MINES AND THE LIKE WORKINGS

[76] Inventor: Bryon T. Oulsnam, Moon Fleet, Back Lane, Whiston, Near Cheadle, Stoke-on-Trent, Great Britain

[21] Appl. No.: 471,501

[22] Filed: Mar. 2, 1983

[30] Foreign Application Priority Data

Mar. 4. 1982 [GB] United Kingdom ..... 8206350

[51] Int. Cl.[3] ..... E02D 5/74

[52] U.S. Cl. ..... 405/260; 405/259; 405/258; 405/244

[58] Field of Search ..... 405/259, 260, 261, 262, 405/244, 258, 231, 233

[56] References Cited

U.S. PATENT DOCUMENTS 3,212,269 10/1965 Olsen ..... 405/260
3,326,004 6/1967 Williams ..... 405/260
3,754,401 8/1973 Lipow ..... 405/259
4,116,368 9/1978 Smith ..... 405/260 X

FOREIGN PATENT DOCUMENTS 918086 9/1954 Fed. Rep. of Germany ..... 405/260
1945493 3/1971 Fed. Rep. of Germany ..... 405/260

*Primary Examiner*—Dennis L. Taylor
*Attorney, Agent, or Firm*—Scrivener, Clarke, Scrivener and Johnson

[57] ABSTRACT

In the installation of a roof bolt in the roof of a mine, a hole is driven vertically upwards into the rock above the mine roof and the bolt is pushed up the hole. Moist grit is blown up the annular gap around the shank of the bolt and packs into the gap to anchor the bolt in place. The air can escape from the bottom of the hole. The bolt may be tubular and form a duct for escaping air. When the gap is full of grit a sealing washer is pushed into the bottom part of the hole. A roof plate is located against the roof and held in place by a nut screwed to the projecting lower end portion of the bolt.

9 Claims, 5 Drawing Figures

ROOF BOLTS FOR MINES AND THE LIKE WORKINGS

Figure 1:
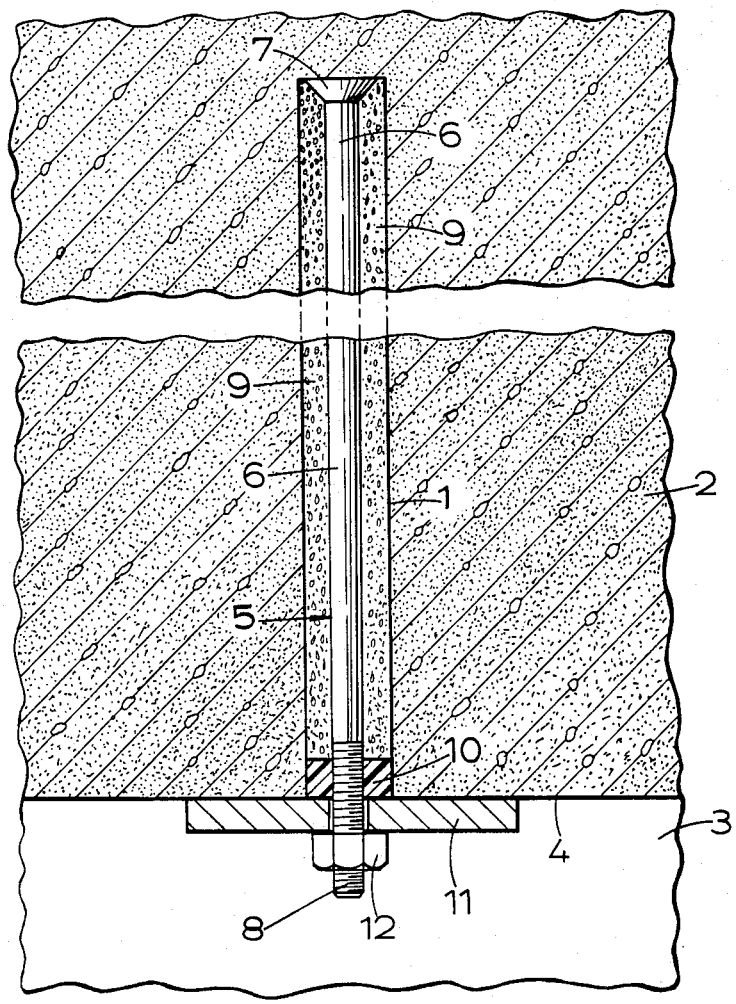

This invention relates to roof bolts for mines and the like workings.

In mines and other workings where an open space extends beneath a layer of rock, there is often a danger that some of the rock immediately above the space will fall. Rock is normally very weak in tension and often tends to break when extending over an open space, particularly where cracks are already present.

It is therefore the practice to support the roofs of mines and like workings with the aid of roof bolts. In the installation of a form of roof bolt now widely used, a vertical hole is drilled upwards into the roof. One or more containers containing chemicals that react when mixed to form a resinous material are pushed to the top of the hole. A steel roof bolt is then inserted into the hole and is rapidly rotated as it is inserted. The rotating bolt breaks the container or containers and mixes the chemicals. They react together to form a resin which fills the annulus between at least an upper part of the bolt and the wall of the hole. The resin sets relatively quickly to form an anchorage for the bolt. A lower end portion of the bolt, which is screw-threaded, projects downwards from the hole. A metal plate with a hole in its centre is fitted onto the projecting end portion of the bolt and is secured in place by a nut which is screwed onto that projecting end portion. The nut is tightened so as to press the plate against the roof.

Thus a roof bolt helps to hold or tie together rock that is immediately above the mine or working and rock that is spaced further above the mine or working. In some instances a relatively thin layer of rock immediately above the mine or working and forming the roof thereof is of a kind, such as shale, that is unsound and has a pronounced tendency to break up and fall, while the rock above that layer is sound. In that case a roof bolt can serve to hold the unsound layer to the sound layer. In other instances a relatively thick layer of rock above the mine or working is somewhat unsound, the thickness of the layer being greater than the length of the bolt. In that case the bolt helps to consolidate the rock and so to prevent the exposed parts breaking up or falling.

While roof bolts anchored in the manner described above generally operate satisfactorily in use, the chemicals used are relatively expensive. Attempts have been made to reduce that problem by decreasing the size of the hole and thus reducing the quantities of the resin-forming chemicals required. However, to drill long and relatively narrow holes in rock is difficult and may require the use of special and more expensive drills.

A problem that can arise with the use of resin-forming chemicals is that the chemicals may fail to be mixed thoroughly so that only a weak anchorage is formed; another problem is that the chemicals are corrosive so that great care has to be taken to avoid their coming into contact with the user's skin.

An aim of the present invention is to provide a method of anchoring roof bolts that avoids or reduces those difficulties and problems.

From one aspect the present invention consists in a method of installing a roof bolt in a mine or like working comprising the steps of forming a hole in the rock above the roof of the mine or like working, the hole extending upwards and its lower end communicating with the mine or like working, inserting a roof bolt into the hole, blowing incompressible particulate material into the hole, around the bolt, and preventing the material subsequently falling from the hole.

The term rock is used herein in a broad sense so as to include materials such as coal and shale and to include stratified materials of different constitutions.

The hole is preferably formed by drilling vertically upwards (or substantially vertically upwards) from the mine or like working.

The roof bolt preferably has a head at its upper end. The head may be of any suitable shape. It may, for example, be of generally disc-like shape, but is preferably of generally frusto-conical shape, being so shaped that over at least part of the length of the head the cross-section of the bolt progressively increases towards the adjacent end of the bolt. The roof bolt preferably has a lower end portion that is screw-threaded for co-operation with a nut, or the like, serving in use to support a plate of the conventional kind described above or to support some other component serving a purpose similar to that carried out by such a plate. The shank of the bolt, above any such threaded end portion and below any such head, is preferably cylindrical and relatively smooth, although it may be formed with irregularities such as projections, grooves or even a screw thread so as to enable it more readily to co-operate with the particulate material.

The incompressible particulate material preferably comprises grit, and at least half the weight of the grit preferably comprises grains which are of a size between 2 mm and 3 mm. If a finer material such as sand is used, it may prove difficult to prevent it from subsequently falling from the hole. The particulate material is preferably blown into the hole with a stream of air, the material progressively filling the hole from the upper end of the hole and the air escaping through the mouth of the hole (at the lower end of the hole) and in some instances through fissures in the rock as well. If desired, a gaseous material other than air may be used, either alone or in conjunction with air, to blow the particulate material into the hole. The particulate material is preferably moist as this tends to cause it to be retained in the hole during the blowing operation, and to give time to take the necessary steps to prevent the material subsequently falling from the hole. It would be possible to mix with the particulate material a chemical or chemicals that would set or would otherwise cause the particles to be bonded together. In general, however, it is preferred to allow relative movement to occur between the particles, for in time the particles can then shift and settle and anchor the bolt still more firmly in position. Any such movement is generally quite slight in extent. This kind of movement of the particles may result from vibrations in the rock arising from activities elsewhere in the mine or like working, such as shot-firing.

To prevent the particulate material subsequently falling from the hole it may be sufficient to secure a plate to a projecting lower end portion of the bolt in the conventional manner described above. Where the material or some of the material is relatively fine, however, there may be a tendency for the fine material gradually to leak from the hole in use. Further, as it is likely that particulate material will gradually settle somewhat, the bolt may tend to move downwards slightly, in which case some of the material might escape. It is the usual practice in mines and like workings regularly to inspect roof bolts and to tighten up any loose retaining plates, but even if this practice were assiduously followed there might be some occasional loss of material. It is therefore preferred to seal a lower end portion of the hole, around the bolt, using sealing means distinct from any retaining plate. Preferably sealing means is inserted into the hole to prevent particulate material falling from the hole. For example the sealing means may comprise one or more resilient washers; the washer or washers may be pushed onto the lower end portion of the bolt and into the mouth of the hole up as far as the particulate material, the washer or washers forming a seal between the bolt and the wall of the hole. Alternatively a chemical or chemicals may be introduced, either alone or mixed with particulate material, and caused or allowed to set form a seal. Such a seal of course need do not more than serve to prevent the outflow of particulate material and therefore need not be load-bearing.

The particulate material is preferably blown into the hole from a duct temporarily attached to a lower end portion of the bolt. Further, the particulate material may be blown into the hole in a stream of air or other gas at least part of which escapes from the hole by flowing downwards through a longitudinally extending duct inside the bolt.

From another aspect the present invention consists in a mine or like working having a roof bolt or roof bolts that has or have been installed by a method according to said one aspect of the present invention that is outlined above.

From another aspect the present invention consists in a roof bolt that has been installed by a method according to said one aspect of the present invention that is outlined above.

The invention also includes within its scope novel roof bolts for use in carrying out the method of installation outlined above. Thus the invention includes a roof bolt having a head at its upper end, the head being of generally frusto-conical shape, being so shaped that over at least part of the length of the head the cross-section of the bolt progressively increases towards the adjacent end of the bolt. The invention also includes a roof bolt having a longitudinally extending duct inside it communicating with the exterior of the bolt at or near both the upper and lower ends of the bolt.

Figure 2:
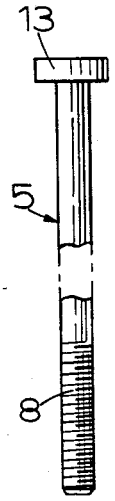
Figure 3:
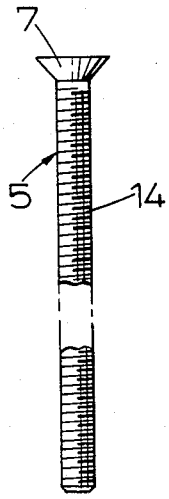
Figure 4:
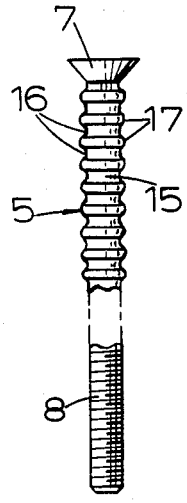
Figure 5:
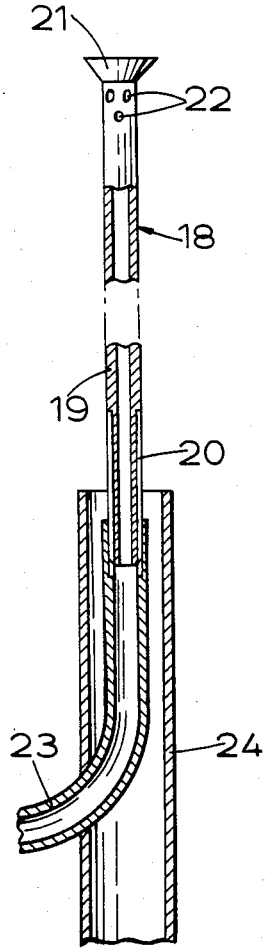

Methods of installing roof bolts in a mine, in accordance with the present invention, will now be more particularly described, by way of example, with reference to the accompanying drawings, in which:

FIG. 1 is a vertical section through rock extending above a mine working and through a roof bolt embodying the present invention, FIG. 2 is a side view of a modified form of roof bolt which may be substituted for the roof bolt shown in FIG. 1, FIG. 3 is a side view of another modified form of roof bolt, FIG. 4 is a side view of yet another modified form of roof bolt, and FIG. 5 is a vertical section through another type of roof bolt and adjacent parts of associated apparatus for use in installing the bolt.

In the installation of the roof bolt shown in FIG. 1, a vertical hole 1 is drilled in the rock 2 above the mine working 3. The hole extends through the roof 4 of the working 3 and its lower end communicates with the working. The rock adjacent to the roof 4 may be cracked or in danger of falling owing to the fact that owing to its own weight it is in tension and is unsupported below. The hole 1 extends upwards into sound rock that is not in danger of falling or is at least in very little danger of falling. The hole may be of any suitable length to achieve this end. A typical hole is up to five feet long (1.52 m).

A steel roof bolt 5 is inserted into the hole. The bolt comprises a smooth, cylindrical shank 6 with a head 7 at its upper end and with a lower end portion 8 that is screw-threaded. The head 7 is of frusto-concial shape, its cross-section progressively increasing towards the top of the bolt. When the bolt is first inserted a gap of tubular or annular shape remains between the wall of the hole 1 and that part of the bolt beneath the head 7. The gap may be of any suitable width, but the radial width of a typical gap is between about a quarter of an inch and about half an inch (6.4 mm and 12.7 mm). The hole 1 may be between about one and a quarter inches and about one and three quarter inches (31.7 mm and 44.5 mm) in diameter. In one particular arrangement the hole is of 44 mm diameter and the shank 6 of the bolt is 18 mm in diameter.

Grit 9 that has been moistened with water is then blown upwards into the annular gap around the bolt, the grit being entrained in a stream of air and being discharged with the air from a nozzle directed upwards into the gap from the lower end thereof. The grit progressively fills the gap from the top downwards, the air escaping from the bottom of the hole. If there are cracks or fissures in the rock some of the air may escape through them as well. The grit 9 packs into the gap and tends to remain in place, at least temporarily; the fact that the grit is moist helps to retain the grit in place when the introduction of grit ceases. The introduction of grit continues until the gap is entirely filled with grit, to the lower end of the hole 1. The flow of air and grit is then caused to cease. A little grit may start to fall from the lower end portion of the gap, and to prevent any significant loss of grit, a resilient washer 10, constituting sealing means, is pushed over the lower end of the bolt and upwards into the hole. If necessary two or more such washers may be stacked on top of each other. In a typical installation the washer or each washer is one inch or one and a half inches (25.4 mm or 38.1 mm) thick. The washer 10, or each washer, acts permanently as a seal to prevent the escape of the grit.

A roof plate 11 with a central hole is fitted over the lower end portion 8 of the bolt, this end portion projecting downwards from the hole 1. A nut 12 is screwed tightly onto the end portion 8 and causes the plate 11 to push upwards against the roof 4. The bolt 5 is thus held in tension, but is anchored in place by the grit 9. The plate 11 may be of conventional form; it may for example be square in shape, with sides each four inches (101.6 mm) long.

In time there may be some gradual settlement of the grit 9, in which case it is likely that the bolt will drop a short distance and that it will be necessary to re-tighten the nut 12. In general, however, the settlement of the grit tends to cause its constituent particles to become more tightly interlocked than before and to grip the wall of the hole 1 and the shank 6 more tightly than they did initially.

The grit 9 is such that at least half of the weight thereof is constituted by grains of a size between 2 mm and 3 mm. That is at least half the grit is able to pass through a seive with holes of 3 mm diameter while being retained on a seive with holes of 2 mm diameter.

Bolts similar to that illustrated may be installed in a similar manner at spaced intervals in the working.

FIG. 2 shows a modified form of roof bolt in which the head 13 is of cylindrical or disc-like shape. FIG. 3 shows another modified form of roof bolt in which the shank 14 is screw-threaded over its entire length. FIG. 4 shows yet another modified form of roof bolt in which the shank 15 is formed along its length with circumferential grooves 16 and circumferential projections 17 alternately. When a roof bolt of either of the shapes shown in FIGS. 3 and 4 is in use, there is a tendency for the grit or other particulate material to enter the threads or the grooves 16 and so enhance the grip between the bolt and the material. It is to be understood that the bolts illustrated in FIGS. 3 and 4 merely represent examples of a wide variety of possible forms of bolt having non-cylindrical shanks.

Any suitable apparatus may be used to form and direct the stream of air and grit that is blown into the gap around the bolt. In one form of apparatus there is a discharge nozzle which incorporates a screw-threaded socket at its centre, the socket being supported by a spider from the walls of the nozzle. The screw-threaded end portion of the bolt is screwed into the socket, before or after the bolt is inserted into the hole. In use a stream of air and grit is discharged from the nozzle through the spider and around the socket and the bolt. The outside diameter of the nozzle is less than the diameter of the mouth of the hole in the rock so that after depositing its entrained grit the air can escape through the annular gap remaining between the outside of the nozzle and the edge of the mouth of the hole. When the annular gap is full the socket is unscrewed and a washer, plate and nut are added as described above.

In a modified arrangement, illustrated in FIG. 5, use is made of a roof bolt 18 having a shank 19 in the form of a hollow tube the lower end portion 20 of which is externally screw-threaded. A head 21, similar to the head 7 in FIG. 1, is provided at the upper end of the shank 19. Apertures 22 communicating with the bore of the shank are formed near the top of the shank, below the head. The hollow interior of the tube constitutes a longitudinally extending duct; this duct communicates with the exterior of the tube through the apertures 22 near the upper end of the bolt and through its open end at the lower end of the bolt. During istallation the lower end portion 20 of the bolt 18 is connected to a discharge duct 23, which extends a short way along the axis of an inlet duct 24 through which a stream of air and grit is introduced into the hole. The discharge duct 23 then extends laterally through the wall of the inlet duct 24 and leads to a discharge opening (not shown). In use, air which enters the hole with the grit travels upwards, passes through the apertures 22 in the shank, lengthwise down the bore of the shank, and along the discharge duct 23, to be discharged through the discharge opening.

It is to be understood that the heads of the roof bolts shown in FIGS. 3, 4 and 5 may be replaced by heads of the kind 7 shown in FIG. 2 if desired.

I claim:

1. A method of installing a roof bolt in a mine or like working comprising the steps of forming a hole in the rock above the roof of the mine or like working, the hole extending upwards and its lower end communicating with the mine or like working, inserting a roof bolt into the hole, blowing incompressible particulate material into the hole, around the bolt, and preventing the material subsequently falling from the hole, said particulate material being such that relative movement can continue to occur between the particles so as to enable the particles to shift and settle and thereby anchor the bolt firmly in position.

2. A method according to claim 1 in which the bolt has a head at its upper end.

3. A method according to claim 2 in which the head is of generally frusto-conical shape, being so shaped that over at least part of the length of the head the cross-section of the bolt progressively increases towards the adjacent end of the bolt.

4. A method according to claim 1 in which the particulate material comprises grit, at least half the weight of which comprises grains which are of a size between 2 mm and 3 mm.

5. A method according to claim 1 in which the particulate material is moist so as to assist its being retained in the hole while the method is being carried out.

6. A method according to claim 1 in which sealing means is inserted into the hole to prevent particulate material falling from the hole.

7. A method according to claim 6 in which the sealing means comprises at least one resilient washer.

8. A method according to claim 1 in which the particulate material is blown into the hole from a duct temporarily attached to a lower end portion of the bolt.

9. A method according to claim 1 in which the particulate material is blown into the hole in a gaseous stream at least part of which escapes from the hole by flowing downwards through a longitudinally extending duct inside the bolt.

* * * * *